US009856118B1

(12) United States Patent
Lin

(10) Patent No.: US 9,856,118 B1
(45) Date of Patent: Jan. 2, 2018

(54) LIFTING HOOK ASSEMBLY ESTABLISHING LIFTING HOOK POSTURE DETECTION CARRIER, AND CRANE

(71) Applicant: Handing Lin, Fuzhou (CN)

(72) Inventor: Handing Lin, Fuzhou (CN)

( * ) Notice: Subject to any disclaimer, the term of this patent is extended or adjusted under 35 U.S.C. 154(b) by 0 days.

(21) Appl. No.: 15/514,824

(22) PCT Filed: Sep. 6, 2016

(86) PCT No.: PCT/CN2016/098173

§ 371 (c)(1),
(2) Date: Mar. 28, 2017

(87) PCT Pub. No.: WO2016/177352

PCT Pub. Date: Nov. 10, 2016

(30) Foreign Application Priority Data

Aug. 27, 2016 (CN) ..... 2016 1 0733240

(51) Int. Cl.
*B66C 1/40* (2006.01)
*B66C 13/06* (2006.01)

(52) U.S. Cl.
CPC ..... *B66C 1/40* (2013.01); *B66C 13/06* (2013.01)

(58) Field of Classification Search
CPC ..... B66C 23/344; B66C 23/82; B66C 13/063; B66C 13/46; B66C 23/365; B66C 23/62; B66C 9/00
USPC ..... 33/333
See application file for complete search history.

(56) References Cited

U.S. PATENT DOCUMENTS 2,414,092 A * 1/1947 Charwinsky ..... B66C 1/40 294/82.1
2,772,411 A * 11/1956 Cooper ..... G01C 9/06 116/303
3,865,265 A * 2/1975 Brudi ..... B66F 17/003 212/277
4,452,078 A * 6/1984 Formanek ..... E02F 3/435 33/366.11
5,596,826 A * 1/1997 Barden ..... E02F 9/26 172/430
6,549,139 B2 * 4/2003 Shaw, Jr. ..... B66C 13/44 212/276
7,856,727 B2 * 12/2010 Chiorean ..... E02F 9/2095 33/1 N
8,618,949 B2 * 12/2013 Maynard ..... B66C 15/045 212/276
9,446,934 B2 * 9/2016 Lin ..... B66C 13/46
(Continued)

*Primary Examiner* — Yaritza Guadalupe-McCall
(74) *Attorney, Agent, or Firm* — Luoh J. Wu; Continent Patent Office LLP

(57) ABSTRACT

The present invention relates to a lifting hook assembly establishing a lifting hook posture detection carrier, and a crane. A section having two side connecting plates is connected in series between a moving pulley component and a lifting hook component to form a three-section lifting hook assembly. A platform surface perpendicular to a lifting force line of action of the pulley component or a straight line parallel to the lifting force line of action of the pulley component may be established on the connecting plates. The advantageous effect of the present invention is: in addition to bearing a lifting weight, the present invention accurately detects a lifting hook deviation posture via the platform surface or the parallel straight line.

8 Claims, 4 Drawing Sheets

(56) References Cited

U.S. PATENT DOCUMENTS

2015/0217976 A1* 8/2015 Tanizumi ..... B66C 13/46
703/2
2015/0353329 A1* 12/2015 Lin ..... B66C 13/16
33/333

* cited by examiner

LIFTING HOOK ASSEMBLY ESTABLISHING LIFTING HOOK POSTURE DETECTION CARRIER, AND CRANE

CROSS REFERENCE TO RELATED APPLICATIONS

This application is the national phase of International Application No. PCT/CN2016/098173, filed on Sep. 6, 2016, which is based upon and claims priority to Chinese Patent Application No. 201610733240.1, filed on Aug. 27, 2016, the entire contents of which are incorporated herein by reference.

TECHNICAL FIELD

The present invention relates to a lifting hook assembly establishing lifting hook posture detection carrier and a crane with the lifting hook assembly, specifically speaking a mobile crane, belonging to the technical field of cranes.

BACKGROUND OF THE INVENTION

Unmanned aircrafts have already droned through the sky and pilotless automobiles be able to work on the way have been in test, while the hoistman on a mobile crane can't judge whether a lifting block is vertical during lifting, hence the hoistman is controlled by a hoisting commander based on the information provided by a monitor keeping watch on loads lifted vertically, which isn't in time and accurate.

According to 9.1.4 in Technical Standards for Construction of Large Equipment Hoisting Engineering, the crane hoisting technology should comply with a standard that the deviation angle of the lifting hook should be less than 3° during lifting. According to 12.2.13 in Specification for Hoisting Construction of Petrochemical Engineering, the deviation angle of the lifting hook shouldn't exceed 3° during lifting loads using mobile cranes. The deviation angle can't be detected accurately, because cranes must lift loads with lifting blocks rather than there aren't detecting instruments. Therefor, the key problem is how to detect the deviation angle of the lifting hook on the lifting blocks accurately.

SUMMARY OF THE INVENTION

This object of the invention is achieved in that the lifting hook assembly carrying loads is provided with the lifting hook posture detection carrier and another object is that the lifting hook assembly establishing the lifting hook posture detection carrier is provided for the mobile crane. Meanwhile, the lifting hook assembly mentioned above is also applied for other cranes that need to detect the accurate deviation angle of the lifting hook.

The detection of the deviation angle of a crane's lifting hook is always to detect the lifting rope's swing angle along the lifting rope (or steel wire rope of lifting hook, the same below) so as to get the deviation angle or to detect the upright posture of the lifting hook by adopting the machine vision technology which is difficult to be applied widespreadly to detect the deviation angle of the mobile crane's lifting hook because of various limiting factors, for example, sight, ray, surrounding environment etc. While one of multiple lifting ropes of the pulley block is taken as a detected object under the solution of detecting the deviation angle of the lifting hook along the lifting rope. Even though the pulley block's steel wire rope is orderly wired, the ropes aren't parallel to each other and there exists relative deflection between the coaxial lines of fixed pulley and movable pulley for the reason that the fixed pulley's axis is fixed on the hoisting boom and the axial direction of the movable pulley changes with the direction of the lifting hook's motion and the force of the lifted load compelling, which is observed during hoisting.

The discovery is that the relative deflection between the axes of the fixed pulley and movable pulley around the lifting force action line of the pulley block causes the deflection of the lifting rope of the pulley block relative to the lifting force action line as the rotating center axis, and the deviation angle of the lifting hook should be the angle of the lifting force action line of the pulley block deviating from the vertical line. For mobile cranes on which the deviation angle of the lifting hook is permitted to be only within 3°, the detection result of the swing angle of the lifting rope deviating from the lifting force action line is considered as the deviation angle of the lifting hook that is equal to the angle of the lifting force action line of the pulley block deviating from the vertical line, which leads to an error that maybe makes the detection meaningless and causes that there is no application on the cranes so far even though the detection of the deviation angle of the lifting hook has been always paid attention to and various of ingenious technical solutions detecting the deviation angle of the lifting hook along the lifting rope have emerged in endlessly.

The discovery is that the lifting force action point of the pulley block acting on the axial line of the coaxial movable pulley is offset with the rise and fall of the pulley block because the movable pulley component of the pulley block is connected with the lifting hook component, which leads to a deviation of the detection result of the deviation angle of the lifting hook using an angle measuring instrument established on the lifting hook assembly. The lifting force action line of the pulley block is the lifting resultant force action line passing through every pulley of the pulley block and the lifting force action point of the pulley block is the lifting resultant force action point passing through every pulley of the pulley block.

The offset of the lifting force action point is directly related to the friction coefficient of the pulley bearings of the pulley block and the number of pulley of the pulley block. When the number of pulley of the pulley block is doubled or more, the offset of the lifting force action point make the excessive deviation of the deviation angle of the lifting hook detected on the lifting hook assembly.

Investigate the reason. Because of the multiplication of the number of pulley of the pulley block, the offset of the lifting force action point causes the obliquity angle of the movable pulley component along the direction of the axis of the movable pulley to change abnormally, furthermore, the movable pulley component and the lifting hook component are connected directly by a fender or a board added between the lifting block and the lifting hook, therefore the abnormal change of the obliquity angle of the movable pulley component drives the lifting hook component to change abnormally, hence, the angle measuring instrument established on the lifting hook assembly react to the abnormal change that isn't caused by the swing of the pulley block, which is erroneous. And the deviation angle of the lifting hook on a mobile crane will be detected only within 3°, so the excessive deviation makes the detection pointless.

The discovery is that the offset of the action point of the resultant force of the lifted load's gravity acting on the lifting hook also leads to the deviation of the detection result of the deviation angle of the lifting hook using the angle measuring instrument established on the lifting hook assembly.

The lifted load is hanged on the lifting hook by the steel rope closure, even many ropes, thus the resultant force of the lifted load's gravity acting on the lifting hook may isn't on the axis of the shank of the lifting hook. What's more, the lifting hook can be rotated around the vertical axis, consequently, the action point of the resultant force of the lifted load's gravity acting on the lifting hook can be offset in any direction, likewise, the movable pulley component and the lifting hook component are connected directly by a fender or a board added between the lifting block and the lifting hook, the offset of the action point of the resultant force of the lifted load's gravity causes the lifting hook component to change abnormally, furthermore, drives the movable pulley component to change abnormally, hence, the angle measuring instrument established on the lifting hook assembly react to the abnormal change that isn't caused by the swing of the pulley block, which is erroneous.

A three-section lifting hook assembly comprises a movable pulley component, a lifting hook component and a section connected in series between the movable pulley component and the lifting hook component, and the two ends of the section are respectively connected with the movable pulley component and the lifting hook component through articulated shafts. Moreover, the articulated shaft connecting the movable pulley component and the section is perpendicular to the axial line of the coaxial movable pulley, while the articulated shaft connecting the lifting hook component and the section is perpendicular to the beam articulated shaft which the lifting hook is hanged on.

Preferably, the movable pulley component c1 and the lifting hook component c7 of the three-section lifting hook assembly are connected through two connecting plates c3 located on both sides respectively, then the articulated shaft c2 connecting the movable pulley component c1 and the two connecting plates c3, as well as the articulated shaft c4 connecting the two connecting plates c3 and the lifting hook component c7, is perpendicular to the axial line of the coaxial movable pulley. Hence, when the deviation angle of the lifting hook along the direction of the axis of the movable pulley changes with the rise and fall of the lifting block rather than with the swing of the lifting hook, under the tension of the lifting block lifting loads, the movable pulley component adjusts itself along the articulated shaft connecting the movable pulley component and the section, at present, the axis of the movable pulley is slightly tilted and the movable pulley component is only subjected to tension. Meanwhile, the beam articulated shaft c6 which the lifting hook is hanged on is parallel to the axial line of the coaxial movable pulley, when the action point of the resultant force of the lifted load's gravity acting on the lifting hook is offset, the lifting hook component adjusts itself through the rotation of the beam articulated shaft c6 and the lifting hook component around the articulated shaft c4 connecting the lifting hook component and the section, at present, the axis of the lifting hook c7 is slightly tilted and the lifting hook component is only subjected to tension.

One end of the section is connected in series with the movable pulley component only subjected to tension and the other end of the section is connected in series with the lifting hook component only subjected to tension as well. Consequently, firstly, the lifting force action line of the lifting block must get through the section, then if a platform to whose surface the lifting force action line of the lifting block is perpendicular is installed fixedly on the section, the lifting force action line of the lifting block is always perpendicular to the platform surface during lifting, and if the angle measuring instrument is installed fixedly on the platform surface on the section, the detected angle between the platform surface and the horizontal plane is equal to the real-time deviation angle of the lifting hook numerically; secondly, the real-time deviation angle of the lifting hook detected on the platform surface on the section is independent of the change of the obliquity angle along the direction of the axis of the movable pulley with the rise and fall of the lifting block and the offset of the action point of the resultant force of the lifted load's gravity, while it just depends on the real-time angle of the lifting force action line of the lifting block deviating from the vertical line.

The three-section lifting hook assembly creates conditions for the accurate detection of the deviation posture of the lifting hook:

(1) Provide a platform surface perpendicular to the lifting force action line of the lifting block for the detection of the deviation posture of the lifting hook:

the platform whose surface is horizontal when the deviation angle of the lifting hook is 0° is installed fixedly on the section of the lifting hook assembly, and the lifting force action line of the lifting block is perpendicular to the platform surface, hence, the accurate detection of the deviation posture of the lifting hook is going on via the platform surface, for example, a bi-axial inclinometer installed on the platform surface can detect XY axial component of the real-time deviation angle of the lifting hook and the real-time deviation angle of the lifting hook is got after composite processing.

(2) Provide a straight line parallel to the lifting force action line of the lifting block for the detection of the deviation posture of the lifting hook;

the platform whose surface is horizontal when the deviation angle of the lifting hook is 0° is installed fixedly on the section of the lifting hook assembly, and a line fixed on the platform surface is perpendicular to the platform surface, then the line is parallel to the lifting force action line of the lifting block, hence, the detector is installed fixedly on the line perpendicular to the platform surface for the accurate detection of the deviation posture of the lifting hook.

The offset of the lifting force action point of the pulley block acting on the axial line of the coaxial movable pulley with the rise and fall of the pulley block is directly related to the number of pulley of the pulley block. When the number of the pulleys of the pulley block decreases to a certain small value within the normal range, the offset of the lifting force action point makes a normal deviation of the deviation angle of the lifting hook detected on the lifting hook assembly. Therefore, the invention presents a two-section lifting hook assembly comprising a movable pulley component d1, a lifting hook component d5 and a articulated shaft d2 through which the movable pulley component and the lifting hook component are connected together, moreover, the articulated shaft d2 is perpendicular to the axial line of the coaxial movable pulley, while the beam articulated shaft d4 which the lifting hook is hanged on is parallel to the axial line of the coaxial movable pulley.

When the action point of the resultant force of the lifted load's gravity acting on the lifting hook is offset, the lifting hook component adjusts itself through the rotation of the beam articulated shaft d4 and the lifting hook component d5 around the articulated shaft d4 perpendicular to the axial line of the coaxial movable pulley, at present, the axis of the lifting hook d5 is slightly tilted and the lifting hook component is only subjected to tension.

The movable pulley component and the lifting hook component of the two-section lifting hook assembly that are both only subjected to tension are connected in series, thus, the angle measuring instrument can be installed fixedly on the movable pulley component, such as the fender, to detect the real-time deviation angle of the lifting hook, which is independent of the offset of the action point of the resultant force of the lifted load's gravity acting on the lifting hook, furthermore, because said certain value of the number of the pulleys of the pulley block is small, the abnormal change along the direction of the axis of the movable pulley is so slight that it is almost negligible.

The three-section lifting hook assembly is provided for the mobile crane to carry loads and detect the deviation posture of the lifting hook on the section, while the two-section lifting hook assembly is provided for the mobile crane to carry loads and detect the deviation posture of the lifting hook on the fender.

The three-section lifting hook assembly or the two-section lifting hook assembly is also applied for other cranes that need to detect the accurate deviation angle of the lifting hook.

The advantageous effects of the lifting hook assembly establishing lifting hook posture detection carrier and a crane with the lifting hook assembly are as follows: firstly, it benefits from the lifting hook assembly establishing lifting hook posture detection carrier which overcomes the obstacles that are the offset of the lifting force action point of the pulley block and the action point of the resultant force of the lifted load's gravity acting on the lifting hook to the detection of the deviation angle of the lifting hook, so that the accurate detection of the deviation posture of the lifting hook is achieved; secondly, it benefits from that the lifting hook assembly establishing lifting hook posture detection carrier is a integrated mechanism both carrying loads and establishing the detector of the deviation angle of the lifting hook, and the insides of the two connecting plates located on both sides respectively have enough space to install the detector of the deviation angle of the lifting hook, which make it convenient to not only install large capacity rechargeable battery on the detector but also protect the detector; thirdly, it benefits from that the mobile crane is provided with the lifting hook assembly establishing lifting hook posture detection carrier to detect the deviation angle of the lifting hook accurately, accordingly, the situation is changed that the hoistman is controlled by hoisting commander based on the information provided by the monitor keeping watch on the load lifted vertically, which isn't in time and accurate, and the present invention provides indispensable conditions for the further development of the mobile crane.

DETAILED DESCRIPTION OF THE INVENTION

Figure 1:
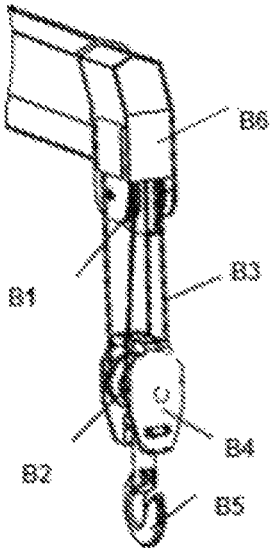
FIG. 1 is a structural view of a lifting block, signs herein: B1—fixed pulley, B2—movable pulley, B3—steel rope, B4—fender, B5—lifting hook, B6—lifting boom.
Figure 2:
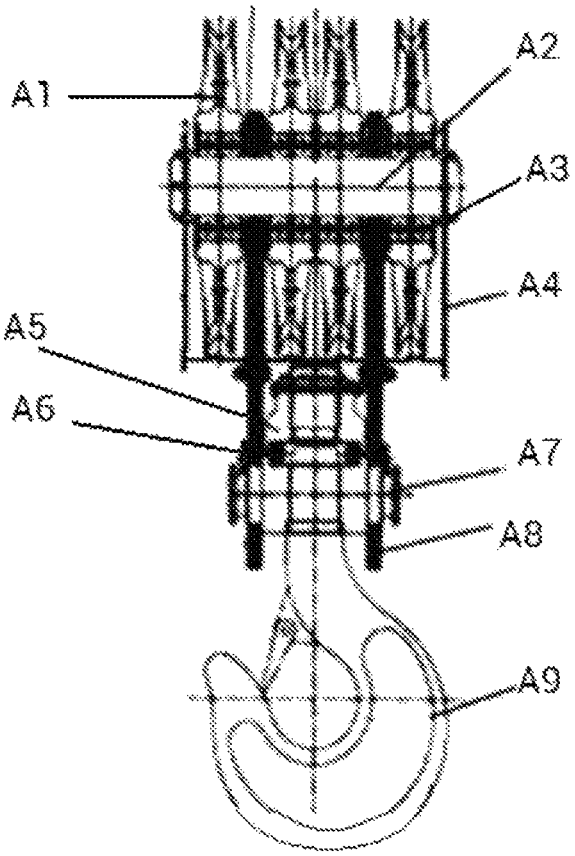
FIG. 2 is a structural view of a lifting hook assembly, signs herein: A1—movable pulley, A2—axis of pulley block, A3—bearing, A4—fender, A5—nut, A6—bearing, A7—beam shaft, A8—board added between the lifting pulley assembly and the hook, A9—lifting hook.
Figure 3:
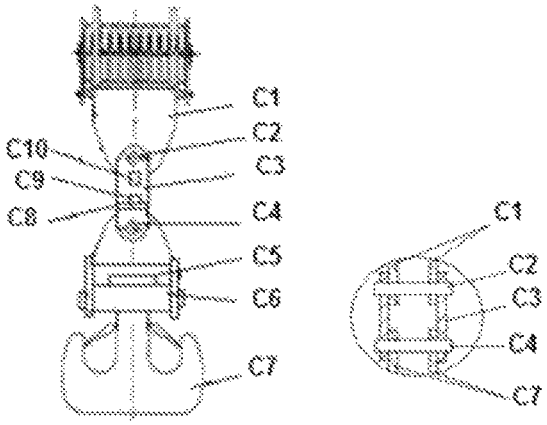
FIG. 3 is a structural schematic diagram of a three-section lifting hook assembly, the right part is the right elevation of the left part in FIG. 3.

The first embodiment is related to a three-section lifting hook assembly. As shown in FIG. 3, the movable pulley component c1 and the lifting hook component c7 of the three-section lifting hook assembly are connected through two connecting plates c3 located on both sides respectively, then the articulated shaft c2 connecting the movable pulley component c1 and the two connecting plates c3, as well as the articulated shaft c4 connecting the lifting hook component c7 and the two connecting plates c3, is perpendicular to the axial line of the coaxial movable pulley. The lifting hook is supported on an articulated shaft c6 (or called beam shaft) with a lock nut c5 pressing a thrust bearing and can be rotated around the vertical axis of the shank of the lifting hook (or called the axis of the lifting hook), hence, the axial line of the movable pulley also can be rotated around the vertical axis of the shank of the lifting hook with respect to the lifting hook. When the deviation angle of the lifting hook changes with the rise and fall of the lifting block rather than with the swing of the lifting hook, the movable pulley component adjusts itself along the articulated shaft c2 connecting the movable pulley component and the section, at present, the axis of the movable pulley is slightly tilted and the movable pulley component c1 is only subjected to tension. Meanwhile, when the action point of the resultant force of the lifted load's gravity acting on the lifting hook is offset, the lifting hook component adjusts itself through the rotation of the beam articulated shaft c6 parallel to the axial line of the coaxial movable pulley and the rotation of the lifting hook component around the articulated shaft c4 connecting the lifting hook component and the section, at present, the axis of the lifting hook is slightly tilted and the lifting hook component c7 is only subjected to tension.

Because the three-section lifting hook assembly comprises the movable pulley component, the lifting hook component and the two connecting plates c3 located on both sides respectively whose two ends the two articulated shafts are respectively provided on and whose two ends are respectively connected in series with the movable pulley component only subjected to tension and the lifting hook component only subjected to tension, the connecting plates creates conditions for the accurate detection of the deviation posture of the lifting hook. The detector only installed on the connecting plates makes it independent of the change of the obliquity angle along the direction of the axis of the movable pulley with the rise and fall of the lifting block and the offset of the action point of the resultant force of the lifted load's gravity to detect the deviation posture of the lifting hook accurately. For example, the platform c8 whose surface is horizontal when the deviation angle of the lifting hook is 0° is installed fixedly on the section of the lifting hook assembly, and bi-axial dynamic inclinometer c9 is installed on the platform surface, then the real-time deviation angle of the lifting hook equal to the angle between the platform surface and the horizontal plane can be gained through composite processing.

Meanwhile, the insides of the two connecting plates located on both sides respectively have enough space to install the detector of the deviation angle of the lifting hook, which make it convenient to not only install large capacity rechargeable battery on the detector but also protect the detector, thus, the three-section lifting hook assembly can be a integrated mechanism carrying loads, creating conditions for the accurate detection of the deviation posture of the lifting hook and establishing the detector.

Figure 4:
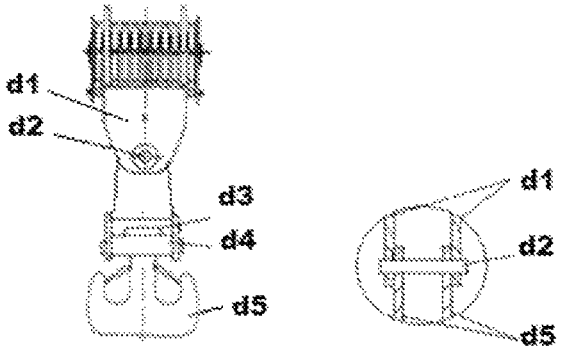
FIG. 4 is a structural schematic diagram of a two-section lifting hook assembly, the right part is the right elevation of the left part in FIG. 4.

The second embodiment is related to a two-section lifting hook assembly. As shown in FIG. 4, a two-section lifting hook assembly comprises a movable pulley component d1, a lifting hook component d5 and an articulated shaft d2 through which the movable pulley component d1 and the lifting hook component d5 are connected together, moreover, the articulated shaft d2 is perpendicular to the axial line of the coaxial movable pulley, while the beam articulated shaft d4 which the lifting hook is hanged on is parallel to the axial line of the coaxial movable pulley.

When the action point of the resultant force of the lifted load's gravity acting on the lifting hook is offset, the lifting hook component adjusts itself through the rotation of the beam articulated shaft d4 and the lifting hook component around the articulated shaft d2 perpendicular to the axial line of the coaxial movable pulley, at present, the axis of the lifting hook is slightly tilted and the lifting hook component d5 is only subjected to tension.

The movable pulley component and the lifting hook component of the two-section lifting hook assembly that are both only subjected to tension are connected in series, thus, the angle measuring instrument can be installed fixedly on the movable pulley component, such as the fender, to detect the real-time deviation angle of the lifting hook, which is independent of the offset of the action point of the resultant force of the lifted load's gravity acting on the lifting hook, furthermore, because said certain value of the number of the pulleys of the pulley block is small, the abnormal change along the direction of the axis of the movable pulley is so slight that it is almost negligible.

The angle measuring instrument installed on the connecting plates of the three-section lifting hook detects the deviation posture of the lifting hook accurately. Specifically, the angle measuring instrument is installed on the platform surface perpendicular to the lifting force action line of the lifting block on the section and the angle between the platform surface used for detection and the horizontal plane is equal to the real-time deviation angle of the lifting hook numerically.

Figure 5:
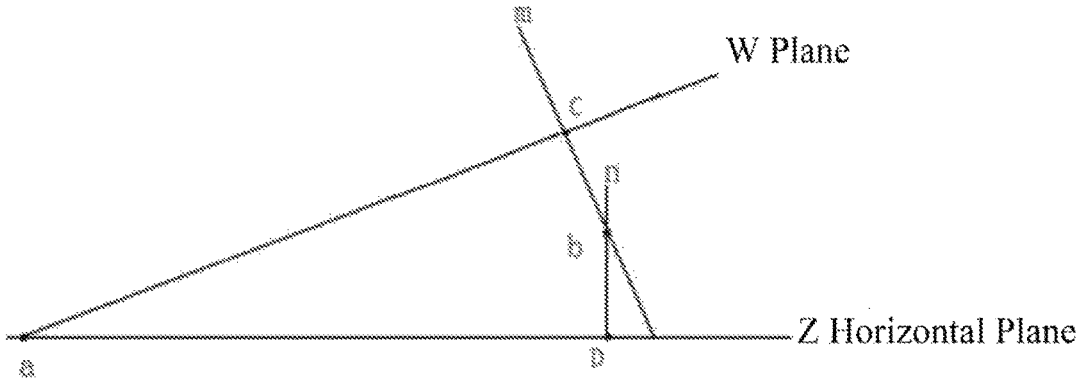
FIG. 5 is a view illustrates that the lifting force action line is applied to detect the deviation angle of the lifting hook.

As shown is FIG. 5, it's assumed that ∠b is the angle that forms at the intersection of the lifting force action line m through point b of the lifting hook and the vertical line through point b of the lifting hook, and that ∠a is the angle that forms at the intersection of the platform surface W perpendicular to the lifting force action line m of the lifting block and the horizontal plane Z; a perpendicular line is constructed from point b in the dihedral angle to surface W and plane Z and the points of intersection are respectively C and D, then a perpendicular line is constructed within the surface W from point C to the line L of intersection of surface W and plane Z at intersection point a, and a straight line is drawn to join point D and point a;

∵L⊥Ca, L⊥bC, ∴L⊥plane bCa, ∴L⊥ba, and ∵L⊥bD, ∴L⊥plane bDa, ∴L⊥Da,

∴∠CaD is the plane angle of the dihedral angle, quadrilateral aCbD is coplanar with line m and line n, and ∠C=∠D=90°, consequently, ∠a (its supplementary angle is ∠CbD) is numerically equal to ∠b that is the acute angle of intersection of line m and line n;

from what has been mentioned above: the real-time deviation angle of the lifting hook is equal to the real-time angle of the lifting force action line of the lifting block deviating from the vertical line which is equal to the real-time angle between the platform surface perpendicular to the lifting force action line of the lifting block and the horizontal plane, and the real-time deviation angle of the lifting hook is coplanar with the real-time dihedral angle that forms at the intersection of the platform surface perpendicular to the lifting force action line of the lifting block and the horizontal plane.

Consequently, the platform surface perpendicular to the lifting force action line of the lifting block is installed on said section or the straight line parallel to the lifting force action line of the lifting block is installed on said section and the angle measuring instrument can be installed fixedly on the platform surface or the parallel straight line so as to detect the deviation posture of the lifting hook.

It should be noted that the foregoing are preferred embodiments of the present invention. To those of ordinary skill, a number of changes and modifications according to the present invention shall also be considered as within the scope of the invention.

What is claimed is:

1. A lifting hook assembly with lifting hook posture detection carrier, comprising a movable pulley component, a lifting hook component, and a section, connected in series between said movable pulley component and said lifting hook component, wherein a first end of the section is connected to said movable pulley component through a first articulated shaft, and a second end of the section is connected to said lifting hook component through a second articulated shaft, wherein the first articulated shaft connecting said movable pulley component and said section is perpendicular to an axial line of a coaxial movable pulley, and the second articulated shaft connecting said lifting hook component and said section is perpendicular to a beam articulated shaft on which said lifting hook is hung;

wherein when the deviation posture of said lifting hook needs to be detected, said section can be provided with a platform surface perpendicular to a lifting force action line of a pulley block or said section can be provided with a straight line parallel to said lifting force action line of said pulley block.

2. The lifting hook assembly with lifting hook posture detection carrier as in claim 1, wherein said section further comprises two connecting plates, located on both sides of said section respectively and connected between said movable pulley component and said lifting hook component of said lifting hook assembly, wherein said first articulated shaft is connected between said movable pulley component and said two connecting plates and said first articulated shaft is perpendicular to said axial line of said coaxial movable pulley, wherein said second articulated shaft is connected between said two connecting plates and said lifting hook component, and said second articulated shaft is perpendicular to said axial line of said coaxial movable pulley, and wherein, said beam articulated shaft on which said lifting hook is hung is parallel to said axial line of said coaxial movable pulley.

3. The lifting hook assembly with lifting hook posture detection carrier as in claim 1, wherein a real-time angle between said platform surface perpendicular to said lifting force action line of said pulley block and a horizontal plane or a real-time angle of said straight line parallel to said lifting force action line of said pulley block deviating from a vertical line is numerically equal to a real-time deviation angle of said lifting hook.

4. A lifting hook assembly with lifting hook posture detection carrier, comprising a movable pulley component, a lifting hook component, and an articulated shaft through which said movable pulley component and said lifting hook component are connected together, wherein said articulated shaft is perpendicular to an axial line of a coaxial movable pulley, while a beam articulated shaft on which said lifting hook is hung is parallel to said axial line of said coaxial movable pulley;

wherein when the deviation posture of said lifting hook needs to be detected, said the fender of the movable pulley component can be provided with a platform surface perpendicular to a lifting force action line of a pulley block.

5. A mobile crane, comprising a lifting hook assembly with lifting hook posture detection carrier, the lifting hook assembly including a movable pulley component, a lifting hook component, and a section, connected in series between said movable pulley component and said lifting hook component, wherein a first end of the section is connected to said movable pulley component through a first articulated shaft, and a second end of the section is connected to said lifting hook component through a second articulated shaft, wherein the first articulated shaft connecting said movable pulley component and said section is perpendicular to an axial line of a coaxial movable pulley, and the second articulated shaft connecting said lifting hook component and said section is perpendicular to a beam articulated shaft on which said lifting hook is hung.

6. The mobile crane as in claim 5, wherein said section further comprises two connecting plates, located on both sides of said section respectively and connected between said movable pulley component and said lifting hook component of said lifting hook assembly, wherein said first articulated shaft is connected between said movable pulley component and said two connecting plates and said first articulated shaft is perpendicular to said axial line of said coaxial movable pulley, wherein said second articulated shaft is connected between said two connecting plates and said lifting hook component, and said second articulated shaft is perpendicular to said axial line of said coaxial movable pulley, and wherein, said beam articulated shaft on which said lifting hook is hung is parallel to said axial line of said coaxial movable pulley.

7. The mobile crane as in claim 5, wherein when the deviation posture of said lifting hook needs to be detected, said section can be provided with a platform surface perpendicular to a lifting force action line of a pulley block or said section can be provided with a straight line parallel to said lifting force action line of said pulley block.

8. The mobile crane as in claim 7, wherein a real-time angle between said platform surface perpendicular to said lifting force action line of said pulley block and a horizontal plane or a real-time angle of said straight line parallel to said lifting force action line of said pulley block deviating from a vertical line is numerically equal to a real-time deviation angle of said lifting hook.

* * * * *